US006786168B1

(12) United States Patent
Foster

(10) Patent No.: US 6,786,168 B1
(45) Date of Patent: Sep. 7, 2004

(54) PORTABLE BOAT BEACHING DEVICE

(76) Inventor: Mark Foster, 5781 Lake Ridge Dr., Ukiah, CA (US) 95482

( * ) Notice: Subject to any disclaimer, the term of this patent is extended or adjusted under 35 U.S.C. 154(b) by 0 days.

(21) Appl. No.: 10/705,964

(22) Filed: Nov. 13, 2003

(51) Int. Cl.[7] ..... B63B 59/02
(52) U.S. Cl. ..... 114/230.1; 405/1
(58) Field of Search ..... 405/1, 3, 7; 114/230.1, 114/361, 44, 219

(56) References Cited

U.S. PATENT DOCUMENTS 3,055,022 A 9/1962 Vallquist
3,693,574 A * 9/1972 Dickey ..... 114/219
5,097,785 A * 3/1992 Zidek ..... 114/219
6,176,195 B1 1/2001 Gregory
6,253,699 B1 7/2001 Arbaugh et al.

* cited by examiner

*Primary Examiner*—Ed Swinehart
(74) *Attorney, Agent, or Firm*—Richard C. Litman

(57) ABSTRACT

A portable boat beaching device that works with a tire to dock or beach a boat at a water's edge, shore-line, or a river bank and the like. The beaching device comprises a flexible tire cover and at least one floatation guide member. The beaching device optionally comprises at least one ballast guide member and/or at least one tire ballast member and/or a cover tightening system.

13 Claims, 9 Drawing Sheets

PORTABLE BOAT BEACHING DEVICE

BACKGROUND OF THE INVENTION

1. Field of the Invention

The present invention relates to a boat beaching device. More specifically, the invention is directed to a portable beaching device that is made of lightweight non-metal materials, which in combination with a tire, can be used to beach a boat without damaging the underside of the boat.

2. Description of the Related Art

Boats come in all shapes and sizes such as fishing boats, powerboats, and pleasure cruise yachts. At some point it is necessary or desirable to dock a boat. A dock such as a marina provides secure moorings for pleasure boats. Such boats comprise a lower bow portion and a forward keel portion; the keel is the chief structural member of a boat that extends longitudinally along the center of its bottom that should not be subject to rough contact with, for example, a river bottom.

A marina typically provides adequate draft to enable a boat or yacht to dock securely without risk of damage to the lower bow and/or forward keel portion of a boat. However, it is sometimes necessary or desirable to, for example, temporarily "dock" a boat by beaching the boat on a beach or riverbank. However, when beaching a boat on rough terrain there is a concomitant risk of damage to the lower bow and/or forward keel of a boat.

U.S. Pat. No. 3,055,022 issued Sep. 25, 1961 to Vallquist, describes a boat beaching apron that is fabricated from flexible, comparatively heavy sheet stock, such as a rubber, plastic, rubberized canvas, or the like and is generally of hexagonal shape. The '022 boat beaching apron is bulky and cumbersome in use. Thus, there is a need for a light weight boat-docking device that allows a marine craft to be beached without substantially damaging the underside of the craft.

U.S. Pat. No. 6,176,195 issued Jan. 23, 2001 to Gregory, describes a floating boat dock assist assembly has a frame with a substantially V-shaped mouth that is truncated by a flexible rubber tire supported by the frame. The '195 device is a dock assist designed explicitly to assist with the docking of a boat to a permanent dock. Unlike the present invention, the '195 device is not suitable for beaching a marine craft.

U.S. Pat. No. 6,253,699 issued Jul. 3, 2001 to Arbaugh et al., describes a watercraft-beaching device that comprises at least one collapsible upright support, a pair of cushioned hull engagement surfaces, and a base clearance block. The overall size and complexity of the '699 device renders the device totally unsuitable as a portable beaching device. In addition, the '699 device takes a lot of effort to erect. Thus, there is a need for a lightweight portable boat beaching device as disclosed in the present invention.

None of the above inventions and patents, taken either singly or in combination, is seen to describe the instant invention as claimed. Thus a boat beaching device solving the aforementioned problems is desired.

SUMMARY OF THE INVENTION

A portable boat beaching device that works with a tire to beach or dock a boat at a water's edge, shore-line, or a river bank and the like. The beaching device comprises a flexible tire cover and at least one floatation guide member. The beaching device optionally comprises at least one ballast guide member and/or at least one tire ballast member and/or a cover tightening system.

Accordingly, it is a principal object of the invention to provide a portable beaching device configured to dock a boat.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
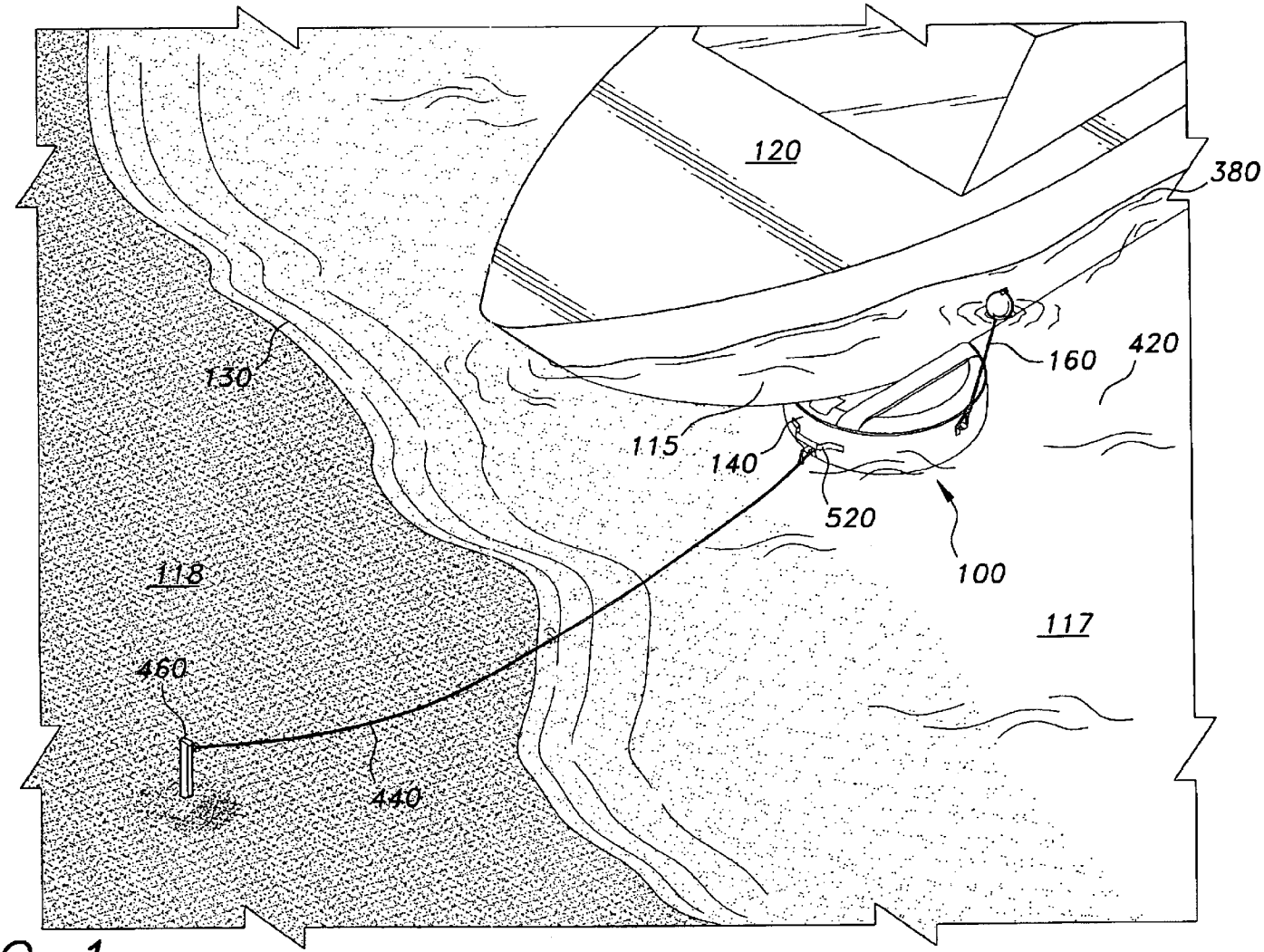
FIG. 1 is an environmental, perspective view of a boat beaching device according to the present invention.
Figure 2:
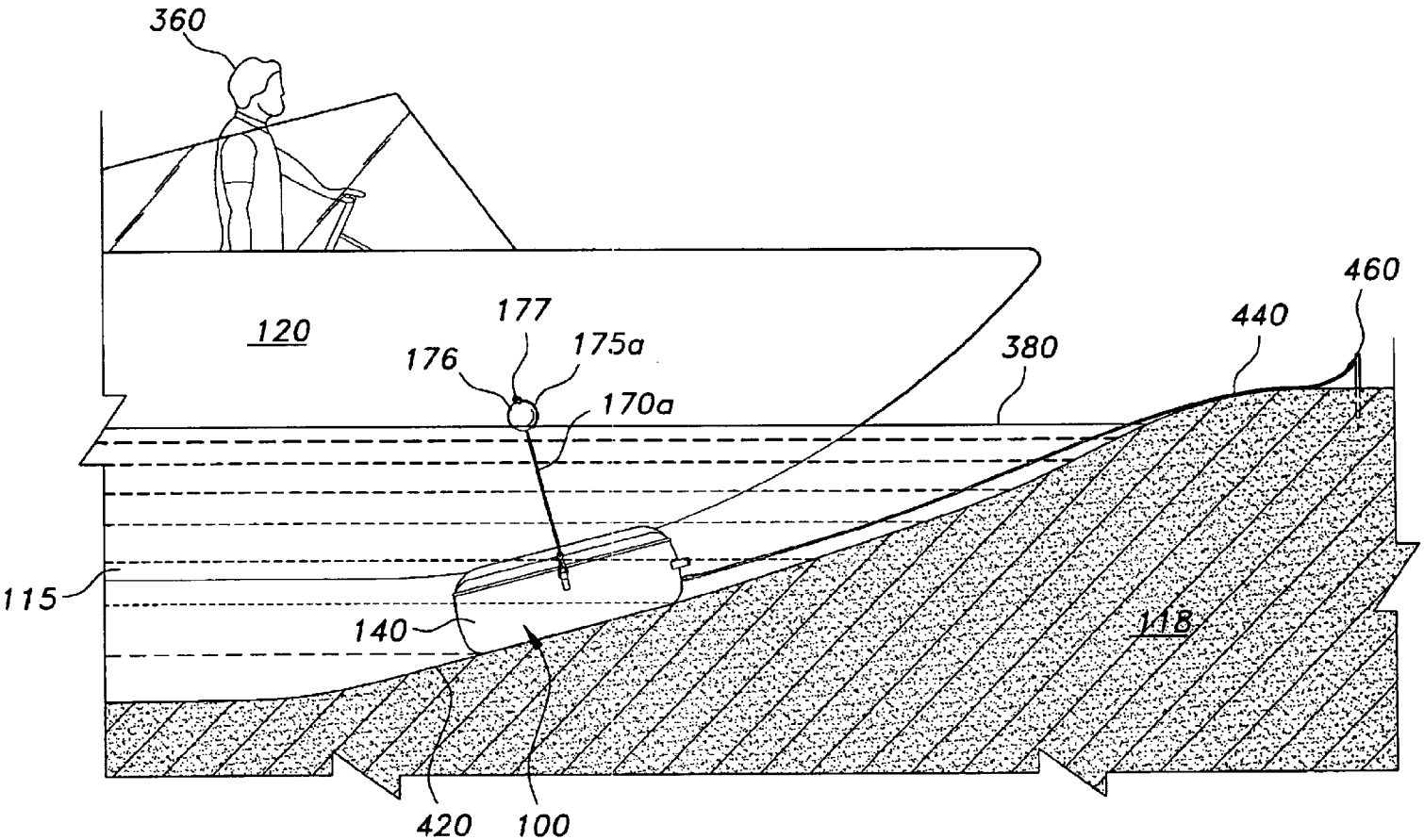
FIG. 2 is a environmental, side view of a boat beaching device according to the present invention.

The invention is directed to a portable beaching device 100 that is made of lightweight non-metal materials, which in combination with a tire 110, can be used to beach or dock a boat 120 on a water's edge 130 without damaging the underside or keel 115 of the boat 120 (see FIGS. 1 and 2). The term "keel" is used to refer to the chief structural member of a boat 120 that extends longitudinally along the center of its bottom and that often projects from the bottom of a boat 120.

The portable boat beaching device 100 is typically used in conjunction with a vehicle tire 110 or similar structure to dock a boat 120 at a water's edge 130, i.e. the interface zone between a body of water 117 (such as a lake, river, or ocean surf) and land 118 (such as a natural or man made beach, or river bank). It should be understood that the term "tire 110" refers to any structure with a general planar configuration like that of a common vehicle tire. It should also be understood that the type of boat 120 that could be docked to the portable boat beaching device 100 (and hence to the water's edge 130) includes fishing boats, powerboats, and pleasure cruise yachts.

Figure 5:
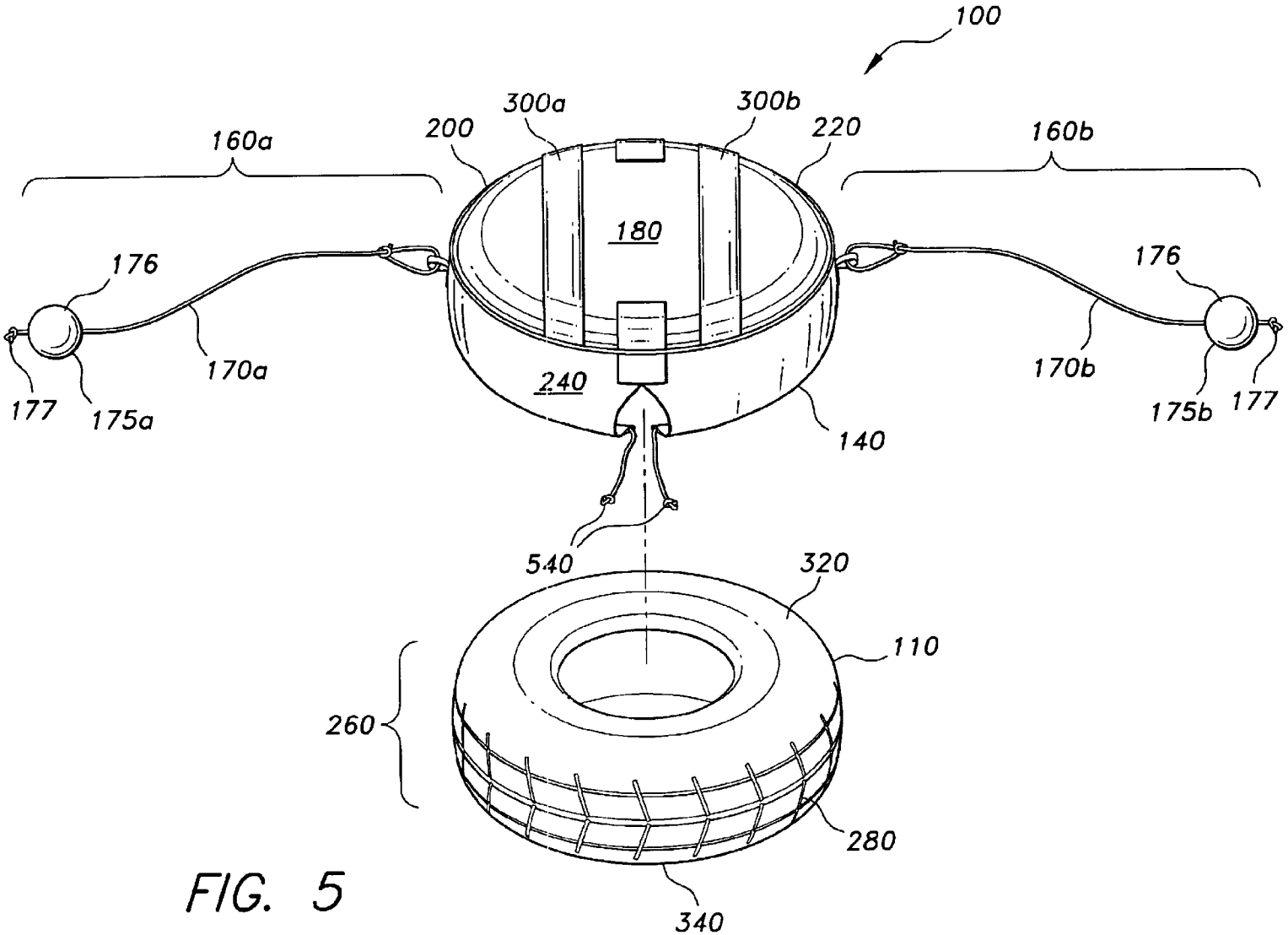
FIG. 5 is a partially exploded view of a boat beaching device in combination with a tire.
Figure 6:
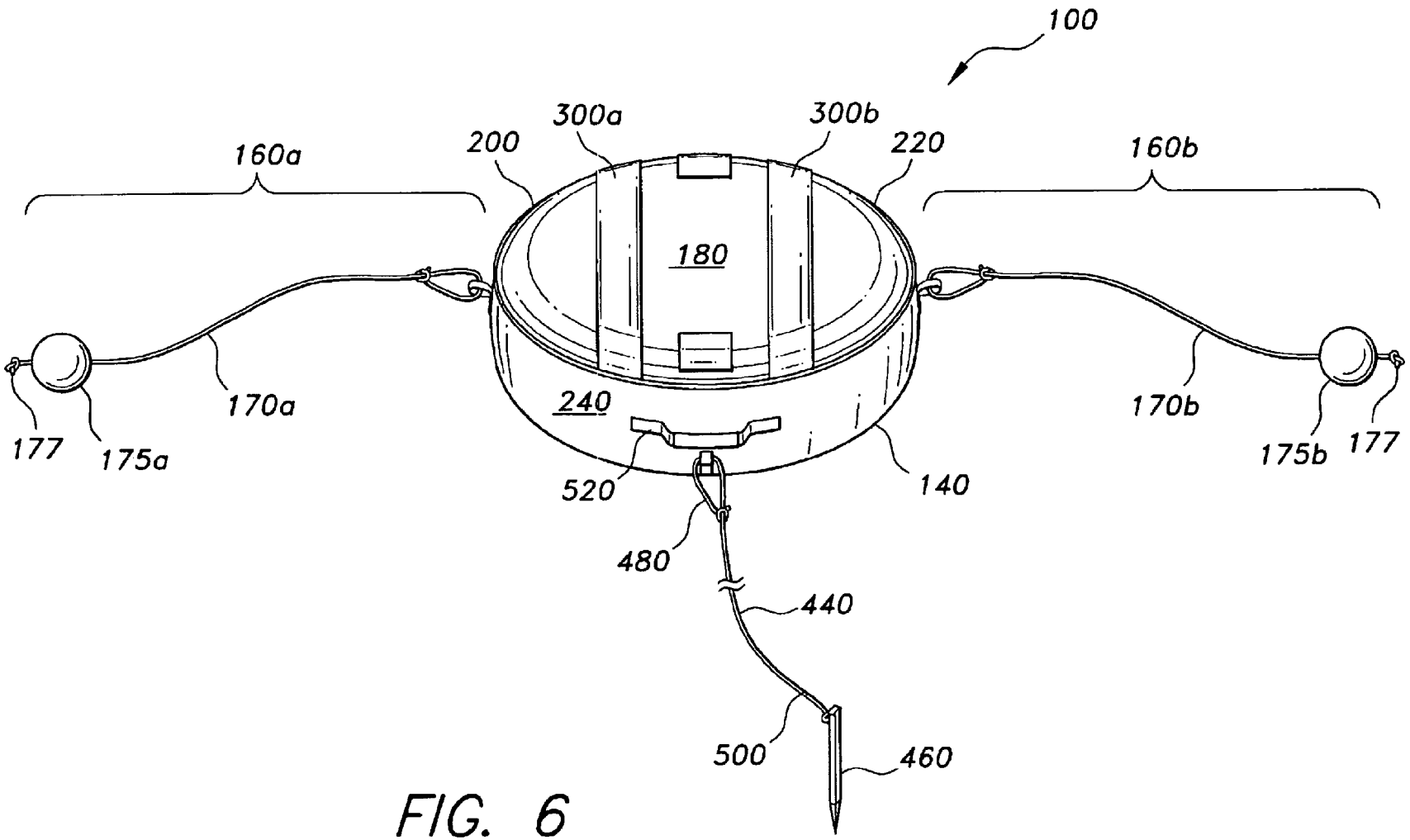
FIG. 6 is a perspective view of the boat beaching device of FIG. 5, but fitted with a handle.
Figure 8:
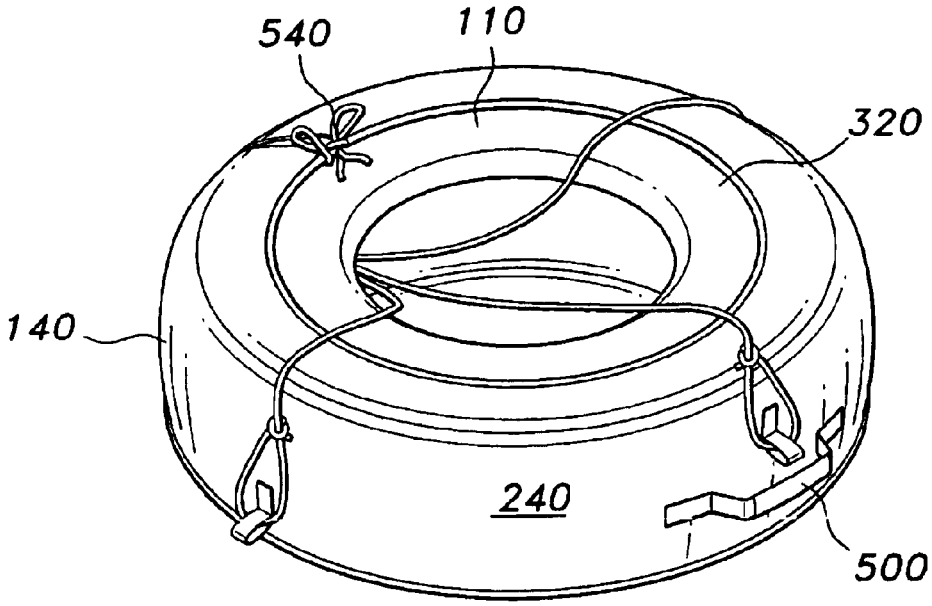
FIG. 8 is a perspective view of boat beaching device fitted with a tightening system according to the present invention.

With respect to one embodiment of the invention, the portable boat beaching device 100 comprises a flexible tire cover 140 and at least one floatation guide member 160 (see, e.g., FIG. 1). The flexible tire cover 140 comprises a top surface 180 with a first 200 and second 220 opposite sides, a side surface 240 configured to cover the circumference side 260 of a vehicle tire 110 (see FIGS. 3, 4A, 4B, 5, 6 and 8), which may or may not define a tire tread 280. The cover may incorporate a cover tightening system 540, and variations thereof, as shown in FIGS. 5 and 8. The cover tightening system 540 ensures a tight fit between the cover 140 and the tire 110.

The top 180 of the tire cover 140 is capable of withstanding contact with the underside or keel 115 of a boat 120. Specifically, the tire cover 140 is adapted to completely cover at least one opposite side 320 or 340 of a tire 110 to prevent tire marks forming on the underside 115 of a boat 120 during contact (i.e. docking or beaching) of the boat 120. The at least one floatation guide member 160 is either tethered or capable of being tethered to the tire cover 140.

Thus, in the first embodiment of the invention it is envisaged that the portable boat beaching device 100 is made or sold without a tire 110 or its functional equivalent. However, the portable boat beaching device 100 is configured to be fitted to a vehicle tire 110, or its functional equivalent, and used to facilitate a boat operator 360 in docking or beaching a boat 120 at a water's edge 130 and the like. It should be understood that the portable boat beaching device 100 is adapted for use at any type of water's edge 130 such as a cobbled shoreline, a sandy beach, and a muddy river bank.

In a preferred embodiment the at least one floatation member 160 comprises a first 160*a* and second 160*b* flotation members respectively tethered to the first 200 and second 220 opposite sides of the tire cover 140. Thus, a boat operator 360 or other person can position or orientate the tire cover to ensure that the first 160*a* and second 160*b* flotation members align in parallel with respect to the water's edge 130 and thereby assist a boat operator 360 in correctly aligning the boat with respect to the portable beaching apparatus 100 to achieve an efficient docking or beaching of the boat 120.

The flotation members 160*a* and 160*b* respectively comprise a tether lines 170*a* and 170*b* respectively connected to water surface members 175*a* and 175*b*. The tether lines 170*a* and 170*b* can be made of any suitable material such as nylon. The tether lines 170*a* and 170*b* are preferably made of a material of material that is less than or close to the density of water (fresh and/or sea water) in order to facilitate floating. The water surface members 175*a* and 175*b* can take any suitable form such as a fishing bobber and/or a fluorescent coated tennis ball that fluoresces or has high light reflectance to assist with nighttime or low visibility docking of the boat 120.

In one embodiment at least one of the water surface members 175*a* and 175*b* is a tennis ball 176 with holes drilled through both sides of the tennis ball to allow a tether line 170*a* and 170*b* to be threaded through the tennis ball; a tennis ball stop such as a knot 177 at one end of the tether prevents the tennis ball 176 from floating off the tether 170*a* or 170*b*. Thus, the drilled tennis ball 176 can run up or down the tether line 170*a* and/or 170*b* to float on the water surface 380.

Figure 3:
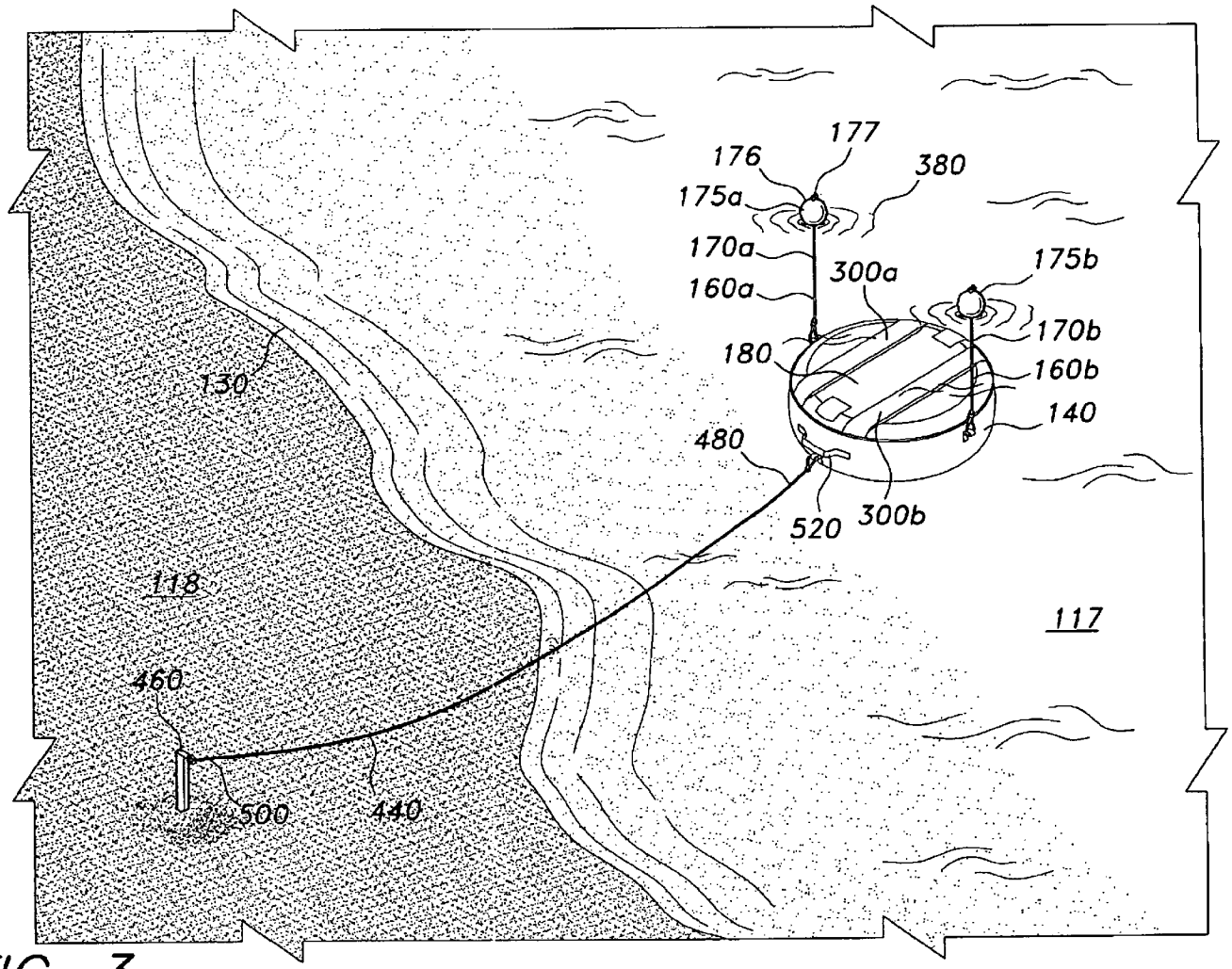
FIG. 3 shows the boat beaching device of FIG. 1 prior to docking a boat thereto.
Figure 4A:
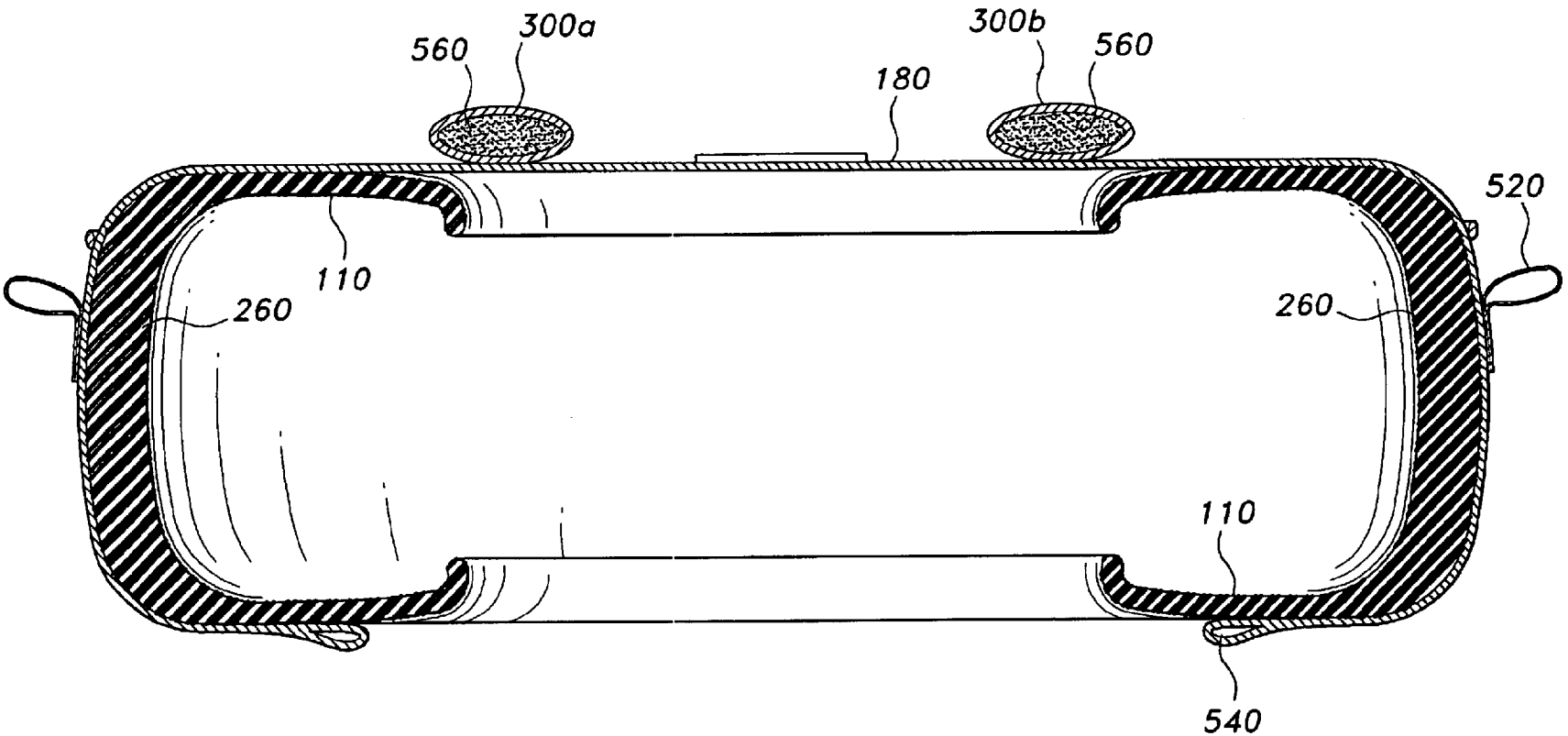
FIG. 4A is a cross-section view of the boat beaching device of FIG. 1.
Figure 4B:
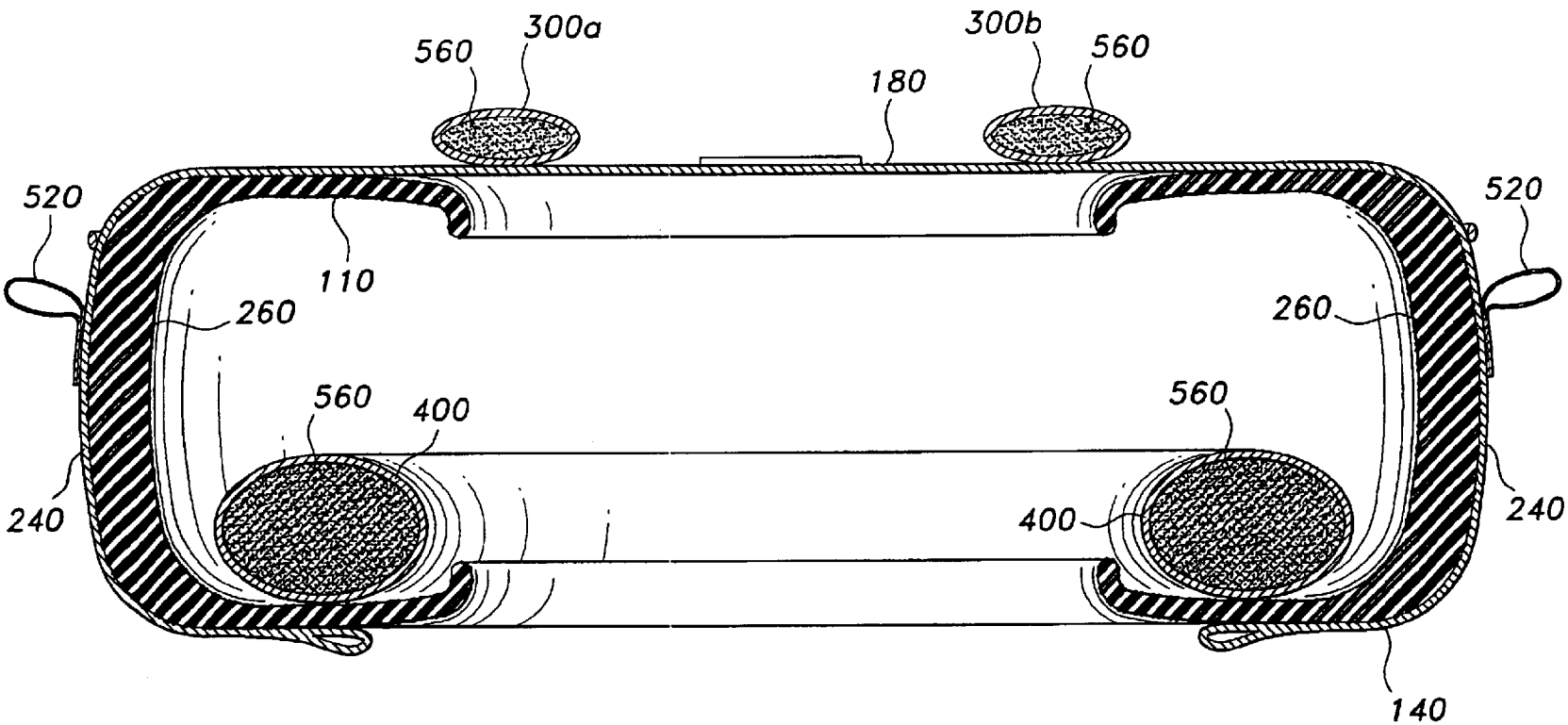
FIG. 4B shows the boat beaching device of FIG. 4A, but fitted with additional ballast.
Figure 7A:
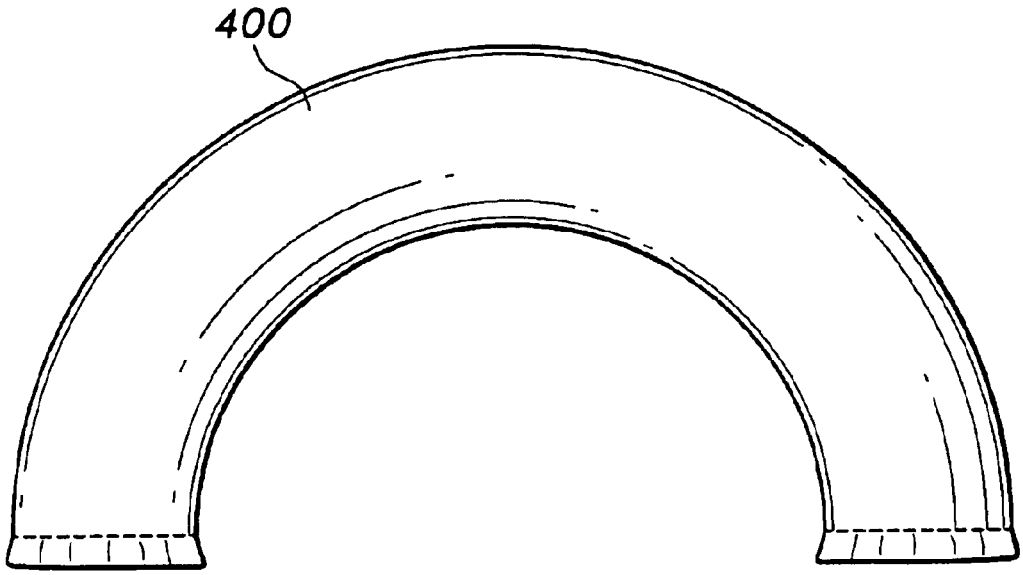
FIG. 7A is a top view of a ballast member according to the invention.
Figure 7B:
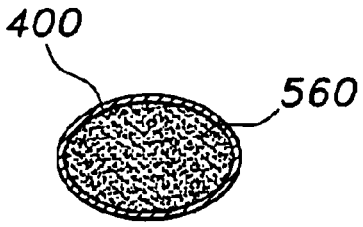
FIG. 7B is a cross-section view of the ballast member of FIG. 7A.

The beaching device 100 optionally comprises at least one ballast guide member 300 (represented by members 300*a* and 300*b* in, e.g., FIG. 3). The at least one ballast guide member 300 provides ballast to help keep the beaching device 100 submerged in a body of water 117, and preferably in contact with the water bottom 420. The at least one ballast guide member 300 may be filled with sand or other inert ballast material 560. The beaching device 100 also optionally comprises at least one tire ballast member 400 (see FIGS. 7A and 7B; represented by labels "400*a*" and "400*b*" in, e.g., FIG. 4B). The at least one tire ballast member 400 may also be filled with sand or other inert ballast material 560.

A flexible securing line 440 terminating in an anchor member 460 can be attached to the beaching device 100. Specifically, the flexible securing line 440 has a first 480 and second 500 opposite ends; the first end 480 is attached to the tire cover 140, and the second end 500 is attached to the anchor member 460. The anchor member 460 can be a stake made of any suitable material such as rigid plastic or metal. One or more handles 520 may be attached to the tire cover 140.

It is to be understood that the present invention is not limited to the embodiments described above, but encompasses any and all embodiments within the scope of the following claims.

I claim:

1. A portable boat beaching device that works with a tire to dock a boat at a water's edge, shore-line, or a river bank and the like, comprising:

a flexible tire cover having a top with a first and second opposite sides and a side surface configured to cover a tire, wherein the tire cover prevents tire marks forming on the underside of a boat upon contact between a boat and a tire fitted with the tire cover; and at least one floatation guide member that is either tethered or capable of being tethered to the tire cover.

2. The portable boat beaching device according to claim 1, wherein the at least one floatation member comprises a first and second flotation members respectively tethered to the first and second opposite sides of the tire cover.

3. The portable boat beaching device according to claim 1 further comprising a tire and at least one ballast guide member to provide ballast and stability to a boat docked to the boat beaching device.

4. The portable boat beaching device according to claim 1 further comprising a tire, at least one ballast guide member and at least one tire ballast member.

5. The portable boat beaching device according to claim 1 further comprising a tire and at least one ballast guide member to provide ballast and stability to a boat docked to the boat beaching device.

6. The portable boat beaching device according to claim 1 further comprising a flexible securing line having a first and second opposite ends, wherein the first end of the securing line is attached to the tire cover, and the second end of the securing line is attached to an anchor member.

7. The portable boat beaching device according to claim 1 further comprising a flexible securing line having a first and second opposite ends, wherein the first end of the securing line is attached to the tire cover, and the second end of the securing line is attached to an anchor member, wherein the anchor member is selected from the group consisting of a plastic stake and a metal stake.

8. The portable boat beaching device according to claim 1 further comprising a cover tightening system.

9. A portable boat beaching device that works with a tire to dock a boat to a shore-line and the like, comprising:

a flexible tire cover having a top with a first and second opposite sides and a side surface configured to cover a tire tread, wherein the top part of the tire cover is capable of withstanding contact with the underside of a marine craft, wherein the tire cover is adapted to completely cover at least one side of a tire to prevent tire marks forming on the underside of a boat upon contact between a boat,and a tire fitted with the tire cover;

a first and second floatation guide members respectively tethered to the first and second opposite sides of the tire cover;

at least one ballast member to provide sufficient ballast to cause a tire to remain submerged in a body of water;

a flexible securing line having a first and second opposite ends, wherein the first end of the securing line is attached to the tire cover; and an anchor member attached to the second opposite end of the securing line.

10. A portable boat beaching device and tire combination adapted to dock a boat to a shore-line and the like, comprising:

a vehicle tire in combination with a flexible tire cover;

at least one floatation guide member that is either tethered or capable of being tethered to the tire cover; and whereby the portable boat beaching device can be used to aid a boat operator in docking or beaching a boat at a water's edge.

11. The portable boat beaching device and tire combination according to claim 10, further comprising at least one ballast member to provide sufficient ballast to cause the vehicle tire to remain submerged in a body of water.

12. The portable boat beaching device and tire combination according to claim 10, further comprising a flexible securing line and an anchor member, the securing line having a first and second opposite ends, wherein the first and second ends of the securing line are respectively attached to the tire cover and the anchor member.

13. The portable boat beaching device and tire combination according to claim 10, further comprising a cover tightening system to ensure a tight fit between the flexible tire cover and the tire.

* * * * *